US009909765B2

(12) United States Patent
Lyons et al.

(10) Patent No.: US 9,909,765 B2
(45) Date of Patent: Mar. 6, 2018

(54) EXHAUST HOOD METHODS, DEVICES, AND SYSTEMS

(75) Inventors: Gregory Lyons, Tompkinsville, KY (US); Derek W. Schrock, Bowling Green, KY (US)

(73) Assignee: OY HALTON GROUP LTD., Helsinki (FI)

( * ) Notice: Subject to any disclaimer, the term of this patent is extended or adjusted under 35 U.S.C. 154(b) by 1077 days.

(21) Appl. No.: 14/130,918

(22) PCT Filed: Jul. 6, 2012

(86) PCT No.: PCT/US2012/045751
§ 371 (c)(1),
(2), (4) Date: Mar. 7, 2014

(87) PCT Pub. No.: WO2013/006789
PCT Pub. Date: Jan. 10, 2013

(65) Prior Publication Data

US 2014/0202445 A1 Jul. 24, 2014

Related U.S. Application Data

(60) Provisional application No. 61/505,520, filed on Jul. 7, 2011.

(51) Int. Cl.
*F24F 13/02* (2006.01)
*F24C 15/20* (2006.01)

(52) U.S. Cl.
CPC ..... *F24C 15/20* (2013.01); *F24C 15/2028* (2013.01); *F24F 13/0245* (2013.01); *Y10T 29/49623* (2015.01)

(58) Field of Classification Search
CPC ... F24C 15/20; F24C 15/2028; F24F 13/0245; Y10T 29/49623
(Continued)

(56) References Cited

U.S. PATENT DOCUMENTS 3,727,753 A 4/1973 Starr et al.
4,124,021 A 11/1978 Molitor
(Continued)

FOREIGN PATENT DOCUMENTS

WO WO2009/129539 A1 * 10/2009 ..... F24C 15/20
WO WO 2010/065793 6/2010

OTHER PUBLICATIONS

International Search Report and Written Opinion for International Application No. PCT/US12/45751, dated Oct. 16, 2012.

*Primary Examiner* — Gregory Huson
*Assistant Examiner* — Dana Tighe
(74) *Attorney, Agent, or Firm* — Potomac Law Group, PLLC; Mark Catan

(57) ABSTRACT

Exhaust hood methods, devices, and systems are disclosed herein that improve the performance of short-circuit hoods. Such improvements can be provided relatively inexpensively by utilizing existing features of the structure of short-circuit hoods. The resulting enhancement in performance may exceed that of a regular exhaust hood while avoiding the pitfalls associated with make-up air injection into the exhaust hood recess. The components of the short-circuit system that inject make-up and/or conditioned air into the exhaust hood recess can be converted into a combination of horizontal and vertical jets at a lower edge of the exhaust hood. A retrofit jet generator can be installed into the short-circuit system outlets. A series of openings in the jet generator can generate the combination of horizontal and vertical jets at a lower edge of the exhaust hood when air from the make-up air or conditioned air source is supplied thereto.

20 Claims, 9 Drawing Sheets

(58) Field of Classification Search
USPC ..... 454/49, 61, 66, 67
See application file for complete search history.

(56) References Cited

U.S. PATENT DOCUMENTS

| | | | | |
|---|---|---|---|---|
| 4,286,572 | A * | 9/1981 | Searcy | F24C 15/20 126/299 D |
| 4,346,692 | A * | 8/1982 | McCauley | F24F 13/075 126/299 D |
| 4,373,509 | A * | 2/1983 | Neitzel | F24C 15/20 126/299 D |
| 5,251,608 | A * | 10/1993 | Cote | F24C 15/2028 126/299 D |
| 6,484,713 | B1 | 11/2002 | Schmitt et al. | |
| 6,851,421 | B2 | 2/2005 | Livchak et al. | |
| 8,038,515 | B2 | 10/2011 | Livchak et al. | |
| 2009/0032011 | A1 | 2/2009 | Livchak et al. | |
| 2011/0021128 | A1 | 1/2011 | Livchak et al. | |
| 2011/0053483 | A1 | 3/2011 | Ritzer et al. | |
| 2011/0094497 | A1 | 4/2011 | Schrock et al. | |
| 2011/0114076 | A1 * | 5/2011 | Robison | F24C 15/20 126/299 D |

* cited by examiner

EXHAUST HOOD METHODS, DEVICES, AND SYSTEMS

CROSS-REFERENCE TO RELATED APPLICATIONS

The present application is a U.S. national stage entry of International Application No. PCT/US12/45751, filed Jul. 6, 2012, which claims the benefit of U.S. Provisional Application No. 61/505,520, filed Jul. 7, 2011, both of which are hereby incorporated by reference herein in their entirety.

FIELD

The present disclosure relates generally to exhaust systems, and, more particularly, to systems, methods, and devices for retrofitting short-circuit exhaust hoods to improve performance thereof.

BACKGROUND

Short-circuit exhaust hoods direct air from an air source toward an exhaust air intake within the recess of the hood to be exhausted together with a load from a fume source. The short-circuit system involves an air source that supplies and directs conditioned air, unconditioned air (typically referred to as make-up air), or a combination thereof into the exhaust hood recess in order to enhance capture and energy efficiency. Short-circuit exhaust hoods have been widely adopted in commercial kitchens due to at least two different motivations. First, it is believed that short-circuit exhaust hoods are more energy efficient than their non-short-circuit counterparts because part of the required exhaust air supply is satisfied with unconditioned air. Second, codes that required a minimum amount of air (in cubic feet per minute (cfm)) to be exhausted from kitchens could be circumvented by the use of short-circuit hoods.

However, most short-circuit hoods simply do not work very well, especially in view of their complexity and cost. In particular, short-circuit hoods have at least two air passages (e.g., one for exhausting fumes and another for introducing make-up air into the exhaust recess) and potentially more than two air passages (e.g., an additional one for introducing conditioned air into the vicinity of the exhaust hood to enhance employee comfort). Despite this added complexity, short-circuit systems have not been able to reduce the volume of conditioned air needed to achieve full capture and containment of a fume load under certain conditions. In fact, a short-circuit system may actually increase the amount of conditioned air that is exhausted. To operate effectively, an exhaust blower or fan for the exhaust hood must operate at a higher speed than if the short-circuit system was not present due to the need to remove not only the effluent-laden air but also the make-up air from the short-circuit supply. Make-up air may also increase turbulence in the vicinity of the fume source, which may increase the volume of conditioned air that is entrained in the effluent, thereby increasing the amount of exhaust required.

SUMMARY

Exhaust hood methods, devices, and systems are disclosed herein that improve the performance of short-circuit hoods. Such improvements can be provided relatively inexpensively by utilizing existing features of the structure of short-circuit hoods. The resulting enhancement in performance may exceed that of a regular exhaust hood while avoiding the pitfalls associated with make-up air injection into the exhaust hood recess. In embodiments of the disclosed subject matter, the components of the short-circuit system that inject make-up and/or conditioned air into the exhaust hood recess can be converted into a combination of horizontal and vertical jets at a lower edge of the exhaust hood. Such conversion may be accomplished by installing a retrofit jet generator or plenum into the short-circuit system outlets. The jet generator may include a sheet metal blank with a series of openings that generate the combination of horizontal and vertical jets at a lower edge of the exhaust hood when air from the make-up air or conditioned air source is supplied thereto.

In embodiments, a closed circuit exhaust hood can have an exhaust-buffering recess and a make-up air discharge configured to direct make-up air from a source directly into the hood recess. A method for improving the performance of a closed circuit exhaust hood can include lowering a total volume of air injected into the hood recess by blocking discharge of the make-up air from the source into the hood recess except through at least one opening having a width of no more than 8 mm, and regulating a pressure in air channels leading to the at least one opening to a pressure of approximately 0.2 to 0.5 in water gauge. An initial velocity of the make-up air discharged from the at least one opening can be at least 4 m/s.

In embodiments, a kitchen exhaust can have an exhaust-buffering recess. A make-up air discharge can be configured to direct make-up air directly into the hood recess. A conditioned air discharge can be configured to generate a conditioned air curtain at a forward edge of the hood. The make-up air discharge can have a make-up air discharge opening connected to a make-up air plenum that receives air from a make-up supply through a make-up air intake collar. The conditioned air discharge can have a conditioned air discharge opening connected to a conditioned air plenum that receives air from a conditioned air supply through a conditioned air intake collar. The make-up air and conditioned air intake collars can have volume control dampers fitted thereto. A method for modifying the kitchen exhaust can include removing grills covering the make-up air and conditioned air discharge openings, and affixing a jet generator over the conditioned air and make-up air discharge openings. The jet generator can have vertical and horizontal faces and can define a jet plenum portion that, once affixed, extends into the hood recess in a horizontal direction to permit air from the make-up air plenum to flow to a lower end of the hood. Each of the vertical and horizontal faces can have at least one opening therein. The at least one opening in the horizontal face can face downwardly and be located at the lower end of the hood once the plenum is affixed. The openings in the vertical and horizontal faces can be located to receive air from the jet plenum portion such that vertical and horizontal jets are generated from the received air.

In embodiments, a kitchen exhaust can have an exhaust-buffering recess. A make-up air discharge can be configured to direct make-up air directly into the hood recess. A conditioned air discharge can be configured to generate a conditioned air curtain at a forward edge of the hood. The make-up air discharge can have a make-up air discharge opening connected to a make-up air plenum that receives air from a make-up supply through a make-up air intake collar. The conditioned air discharge can have a conditioned air discharge opening connected to a conditioned air plenum that receives air from a conditioned air supply through a conditioned air intake collar. The make-up air and conditioned air intake collars can have volume control dampers fitted thereto. A method for modifying the kitchen exhaust can include disconnecting the make-up air intake collar from the make-up air supply, removing the make-up air volume control damper, fitting a fan to the make-up air collar, removing the make-up air and conditioned air discharge grills, and affixing a jet generator over the conditioned air and make-up air discharge grills. The fan can be arranged such that air is drawn thereinto and such that ambient conditioned air is supplied through the make-up air intake collar into the make-up air plenum. The jet generator can have vertical and horizontal faces and can define a jet plenum portion that, once affixed, extends into the hood recess in a horizontal direction to permit air from the make-up air plenum to flow to a lower end of the hood. Each of the vertical and horizontal faces can have at least one opening therein. The at least one opening in the horizontal face can face downwardly and can be located at the lower end of the hood once the plenum is affixed. The openings in the vertical and horizontal faces can be located to receive air from the jet plenum portion such that vertical and horizontal jets are generated from air supplied by the fan.

In embodiments, a method for modifying a short-circuit exhaust hood can include exchanging a jet generator for a make-up air discharge register, which covers an outlet of an air supply plenum and through which air from the air supply plenum enters into a recess of the short-circuit exhaust hood. The exchanging can include removing the discharge register and sealing upper and lower portions of the jet generator around the air supply plenum outlet. The jet generator together with surfaces of the short-circuit exhaust hood can form a plenum that conveys air from the air supply plenum outlet to a plurality of first and second openings in the jet generator. The first openings can be constructed to form horizontally directed jets at a lower end of the recess. The second openings can be constructed to form vertically directed jets at the lower end of the recess. The jet generator can have a protruded shape in cross-section such that both the first and second openings are spaced from the upper portion of the jet generator and the air supply plenum outlet in a horizontal direction.

In embodiments, a jet generating apparatus can be used in a short-circuit exhaust hood having a make-up air supply plenum with an outlet in fluid communication with a recess of the short-circuit exhaust hood. The jet generating apparatus can include a first portion, a second portion, an outlet portion, and an intermediate portion. The first portion can extend in a substantially vertical direction. The second portion can extend in a substantially horizontal direction. The outlet portion can be provided at a horizontal end of the second portion and include a plurality of first and second openings therein. The intermediate portion can connect the first portion to the outlet portion. The first openings can be constructed to form first jets in the horizontal direction, and the second openings can be constructed to form second jets in the vertical direction. The first and second portions can be constructed to seal the air supply plenum outlet when installed in the short-circuit exhaust hood. The outlet portion can have a protruded shape in cross-section such that both the first and second openings are spaced from the first portion in the horizontal direction.

In embodiments, a method for modifying a short-circuit hood can include replacing a make-up air system or conditioned air supply system, which provides a flow of air at a front of the short-circuit hood via a respective outlet, with a jet generator that forms a combination of horizontally and vertically directed jets along a lower portion of a recess of the short-circuit hood at said front.

In embodiments, a short-circuit hood can include a plenum adjacent the hood, the plenum having an interior volume separated from an interior volume of the hood recess by a wall. A method of modifying the short-circuit hood can include removing a portion of the wall to communicate at least a portion of the internal volume of the plenum with the interior volume of the hood recess, thereby expanding the interior volume of the recess. A curved wall can be affixed in position to replace the removed portion of the wall. The curved wall may form a curved angled lip portion at a lower edge of the hood that curves toward a fume intake facing an interior of the hood recess. A jet generator can be affixed to the hood in order to generate generally horizontal and generally vertical jets along the lower edge of the hood. The jet generator may include an integrated or separate controller and sensor for detecting an exhaust load. The controller can be connected to the exhaust system and a rate of flow of the exhaust of the exhaust system may be regulated by the controller responsively to a signal from the sensor.

Objects and advantages of embodiments of the disclosed subject matter will become apparent from the following description when considered in conjunction with the accompanying drawings.

BRIEF DESCRIPTION OF DRAWINGS

Embodiments will hereinafter be described with reference to the accompanying drawings, which have not necessarily been drawn to scale. Where applicable, some features may not be illustrated to assist in the illustration and description of underlying features. Throughout the figures, like reference numerals denote like elements.

DETAILED DESCRIPTION

Figure 1:
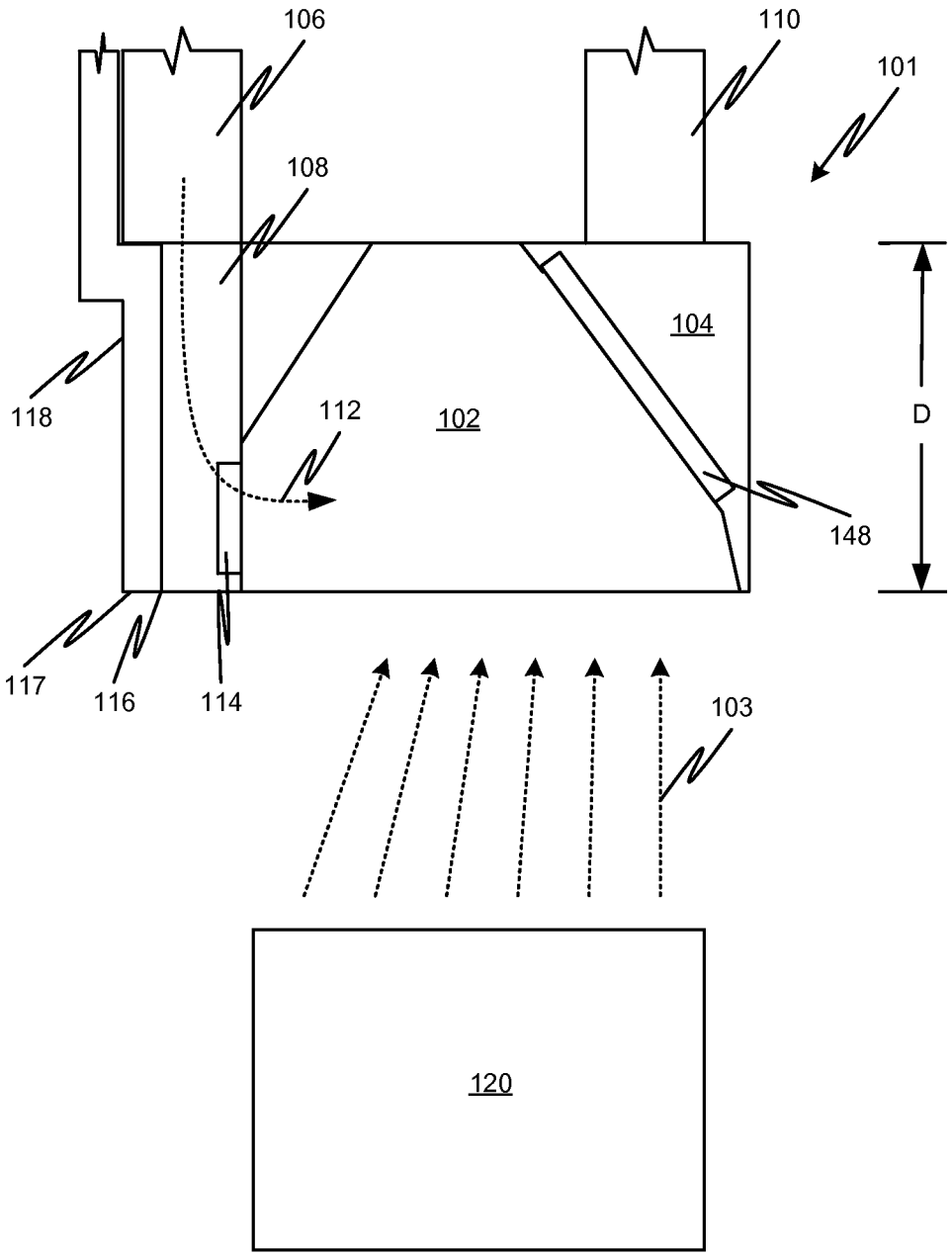
FIG. 1 shows a side cross-section of a short-circuit exhaust hood installed over a cooking appliance.

FIG. 1 shows a short circuit hood 101 that has a recess 102 to buffer exhaust fumes 103 emanating from a cooking appliance 120. The recess 102 can have an aspect ratio in cross-section of approximately one, but may be any depth. The depth of the hood (i.e., D in FIG. 1) is significant and ensures that there is an amount of air retained in recess 102 that can be displaced by pulses of rapid buoyancy-driven hot air ("plug flows" as they are sometimes called) to prevent driving fumes into the ambient space surrounding the hood 101. An exhaust plenum 104 draws gas from the recess 102 and into an exhaust duct 110 drawn by a fan (not shown). Such a fan may be installed remote from the exhaust hood 101, for example, on the roof of a building housing a kitchen where the hood is located. Filter 148 can be arranged between the recess 102 and the exhaust plenum 104 such that fumes pass through the filter en route to the exhaust duct 110. The exhaust hood 101 may also have sidewalls with flat, inwardly facing side surfaces at opposite sides of the hood that bound the recess 102 and define the lateral extent thereof. Such sidewalls 100 may extend the full depth of the hood or only a partial depth of the hood.

Make-up air flows from a supply duct 106 into a supply plenum 108 and out through a discharge grill or register 114. The make-up air may also be supplied by a fan (not shown) located remote from the exhaust hood, for example, on the roof of the building. The discharge grill 114 diffuses and directs a large volume of air directly into the recess. The discharge grill 114 may extend only partly along a width of the hood 101. Note that the width of the hood 101 is taken to be the dimension of the hood in the direction perpendicular to the plane of the cross-section illustrated in FIG. 1 (i.e., into the page of FIG. 1). Optionally, a conditioned air duct 118 may be provided at the front edge 116 of the exhaust hood 101. The conditioned air duct may convey conditioned air from an HVAC duct (not shown) to discharge 117 to form a supply of relatively slow moving air. This conditioned air discharge could be used to improve the comfort level of employees working in the vicinity of the hood, for example, to keep cooks and other employees working with cooking appliance 120 cool and comfortable.

In embodiments of the disclosed subject matter, a short-circuit hood as described with respect to FIG. 1 may be converted into a hood with horizontal and vertical jets at a lower edge of the hood. In particular, the conversion of the make-up air discharge into horizontal and vertical jets that coalesce into planar jets serve to enhance the capture and containment capability of the hood, thereby minimizing the amount of conditioned air required to be exhausted by the hood for adequate removal of produced effluent. The particular range of velocities, positioning, and direction of the jets in combination with a shape of the hood recess, are such as to create a large buffer zone that enhances capture as well as preventing captured fumes from escaping the hood, e.g., due to cross-drafts.

By providing the series of jets at or near the lower edge of the exhaust hood recess, the vertically directed jets can form an air curtain that confines the entry of conditioned air into the exhaust stream to an effective aperture defined by the terminus of the air curtain while the horizontally directed jets can form a virtual barrier to prevent (or at least reduce the amount of) fumes from being drawn from the recess by external air movements. The large volume defined by the canopy interior, extended by the vertically directed jets, creates a large buffer zone to smooth out transients in plug flow. The horizontally directed jets ensure that fumes captured in the exhaust recess can be retained in the exhausted recess until removal by the exhaust plenum. This enhanced capture efficiency permits the exhaust fan (or blower) to operate at a slower speed while enforcing full capture and containment. This in turn minimizes the amount of conditioned air that must be extracted with a concomitant reduction in energy loss.

Figure 2:
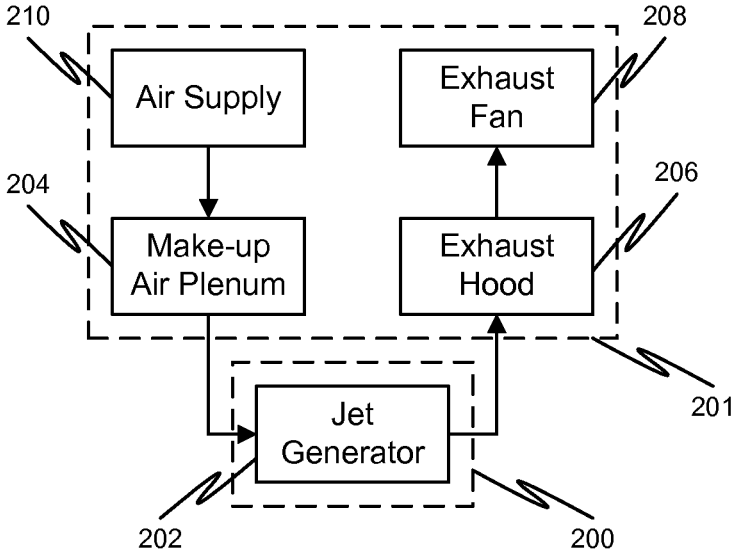
FIG. 2 is a simplified schematic diagram of a modified short-circuit exhaust hood, according to one or more embodiments of the disclosed subject matter.

In general, a conversion device 200 can be added to an already installed short-circuit exhaust system 201, which may include an exhaust fan 208 for removing gas from an exhaust hood 206 and an air supply 210 for supplying air to a make-up air plenum 204 for introduction into the exhaust hood 206. The conversion device 200 includes a jet generator 202 that can be installed between a make-up air plenum 204 and the exhaust hood 206, as shown in FIG. 2, for example at a make-up air outlet of the plenum 204. The jet generator 202 can include a blank (e.g., a sheet metal blank) with a plurality of openings arranged proximal to a bottom edge of the exhaust hood 206. A first set of the openings can generate capture jets that emanate from the jet generator 202 in a horizontal direction. A second set of the openings can generate capture jets that emanate from the jet generator 202 in a vertical direction. The air supply 214, which may provide make-up air and/or conditioned air, conveys air to the jet generator 202, which restricts the air flow in order to form the horizontal and vertical jets. Other components can be provided to redirect air flow in the short-circuit hood 206 and/or increase the flow rate or pressure of air supplied to the blank in order to form the jets.

Individual jets are directed either in a substantially vertical direction (i.e., from the hood toward the ground) or in a substantially horizontal direction (i.e., parallel to the ground and toward the exhaust outlet side of the hood). The jets directed in a particular direction may coalesce into a planar jet (e.g., a vertical curtain jet or an unattached horizontal planar jet) a short distance from the nozzles from which they originate.

Multiple jets that have nozzles with smaller diameters and that propel air at a higher velocity are generally more effective than a single jet with one long and narrow nozzle or even multiple jets with much larger nozzles. The effectiveness of the air jets depends, in large part, on its output velocity. Air jets with larger nozzles must discharge air at a faster rate to achieve a comparable output velocity. On the other hand, smaller nozzles generally produce much smaller scale turbulence and tend to disturb the thermal flow created by the cooking surface to a lesser degree than larger scale turbulence. Smaller nozzles also require less air. Jets with lower output velocities create an air flow that dissipates more quickly due to loss of momentum to viscosity and may have a throw that is only a short distance from the nozzle. Operation and design of the plenums forming the jets can be such that the jets are formed with such dimensions and velocity that the jet air flow dissipates prior to or shortly after reaching the effluent plume 103 and/or the cooking appliance 120.

Each jet can be formed by a respective air nozzle formed in a jet generating plenum. Although not a requirement, the nozzles for generating jets in a particular direction along a particular lower edge of the exhaust hood can be positioned to form a substantially straight line. The nozzles may simply be perforations in a plenum defined by a metal blank of the conversion apparatus attached to the short-circuit system. Alternatively, they may be nozzle sections with a varying internal cross section that minimizes expansion on exit. The nozzles may contain flow conditioners such as settling screens and/or or flow straighteners. The initial velocities of the horizontal jets may be between 2 and 3.5 times the initial velocities of the vertical jets, the initial velocity in this case being the point at which individual jets coalesce into a single planar jet.

The horizontal and/or vertical jets may be directed parallel with respect to each other. That is, horizontal jets may emanate from the plenum and proceed laterally across the lower portion of the recess in non-intersecting directions. Alternatively, some of the horizontal jets may be angled with respect to other horizontal jets. For example, horizontal jets located at corners of the hood, i.e., in or around the intersection of front edge of the hood with its sides may be angled toward the center of the hood where an exhaust vent is located. Thus, when the hood has a relatively large aspect ratio (i.e., width of the front edge of the hood as compared to the width of the side edge of the hood), the horizontal jets at the corners can be angled toward the center to enhance capture and containment of exhaust. Alternatively or additionally, the plenum that forms the jets may have an angled or curved geometry, as viewed in a top-down plan view of the hood, such that horizontal jets emanating in a direction substantially perpendicular to the plenum surface are automatically angled toward the center of the hood.

The horizontal and vertical jets can be formed on the front edge of the exhaust hood (i.e., an edge opposite the exhaust outlet and/or closest to a working edge of the cooking appliance). In addition, the horizontal and vertical jets can be formed at other edges of the exhaust hood, such as, but not limited to side or rear edges of the exhaust hood. A common plenum can be used to form the jets on the front and additional edges of exhaust hood, although multiple separate plenums are also possible according to one or more contemplated embodiments.

Figure 3B:
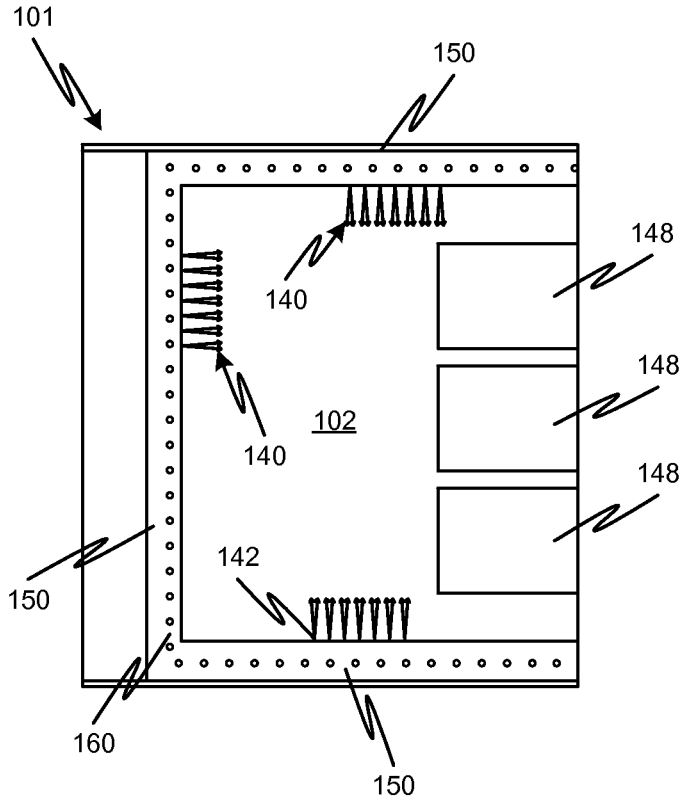
FIG. 3B shows a bottom view of the modified hood of FIG. 2.
Figure 3A:
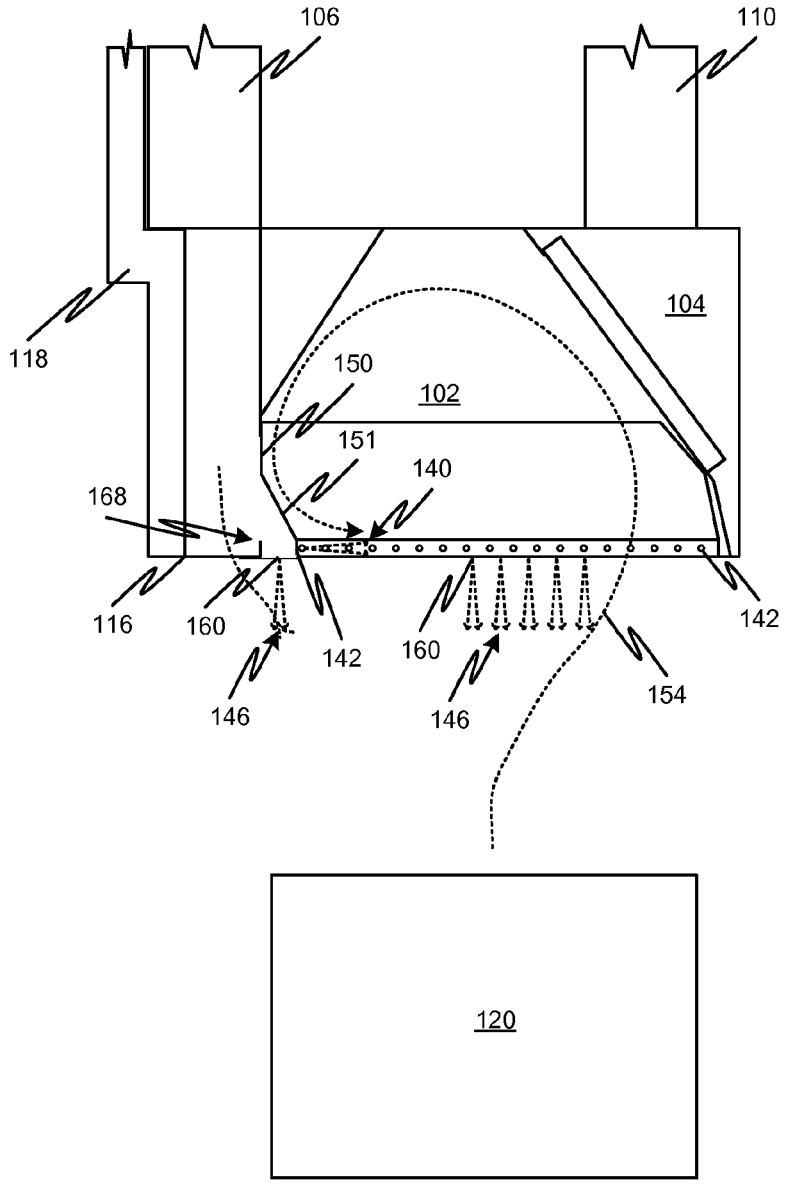
FIG. 3A shows a side cross-section of the short-circuit exhaust hood of FIG. 1 modified to generate horizontal and vertical jets, according to one or more embodiments of the disclosed subject matter.

FIGS. 3A-3B show an exhaust hood 101 after modification (hood 101 shown in FIG. 1 prior to the modification) according to an embodiment of the disclosed subject matter. FIG. 3A shows a side cross-section view of the hood 101 while FIG. 3B shows the hood 101 as viewed from the cooking appliance 120 below the hood. The make-up discharge grill 114 can be removed from the short-circuit supply plenum 108, thereby leaving outlet 168 open. A jet generator 150 can be attached over outlet 168 and sealed thereto. An upper portion 152 of the jet generator may attach to the exhaust hood over an upper end of the make-up air outlet 168 while a lower portion 155 may attach to the exhaust hood over a lower end of the make-up air outlet 168 (e.g., by extending over a portion of the lower edge 116 of exhaust hood). The upper portions 152 and lower portions 155 of the jet generator may seal the jet generator 150 to the make-up air outlet 168 such that air from the short-circuit supply plenum 108 is forced into plenum 153 formed by the jet generator and out through openings 142, 160 therein to form respective jets.

The jet generator 150 can be, for example, an angled sheet metal blank. First openings 142 and second openings 160 can be provided in the angled sheet metal blank. Alternatively or additionally, the first and/or second openings may be formed by interaction of portions of the jet generator 150 with respective portions of the hood 101 and/or supply plenum 108. The shape of the jet generator 150 can be such that at least a portion thereof extends away from the plenum 108 into the area of the recess 102. For example, the jet generator 150 may have a nose shape or other protruded shape in side view. The "nose" shape of the jet generator 150 can include a bevel 151 that directs air at a front portion of the recess 102 back toward the center of the hood, as indicated by the arrow 154.

Figure 4:
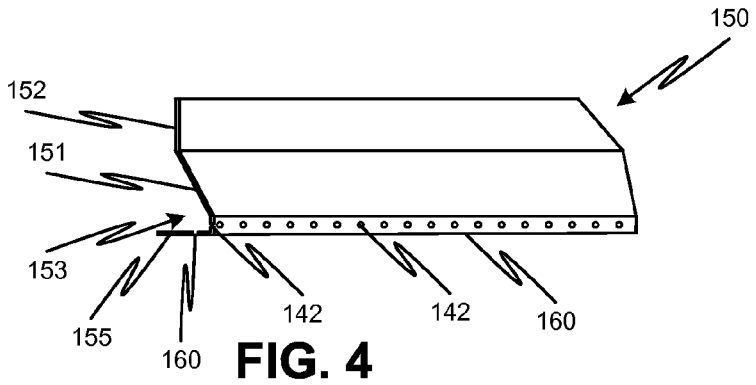
FIG. 4 shows a side cross-section of a jet generator for modifying a short-circuit hood, according to one or more embodiments of the disclosed subject matter.

The jet generator 150 can be formed to extend around the side edges of the hood 101 as well as the front edge thereof. Thus, the jet generator 150 can be constructed to have laterally extending side portions to form a u-shape in top down plan view (see, for example, FIG. 3B). The jet generator 150 attaches to the inside face of the sides 100 along the sides to form a sealed longitudinal plenum that feeds holes 142 and 160 extending along the sides. The arrangement thus forms a small plenum 153 that wraps around the inside facing perimeter of the hood, attaching to the inward face of the sides 100, as shown in FIG. 4. The make-up air supply plenum 108 may only be provided at the front edge of the exhaust hood; however, the interaction between the outlet 168 and the jet generator 150 at the front edge of the hood may be sufficient to supply air to the portions of the jet generator along the front and side edges via plenum 153. The interior of the jet generator 150 forming plenum 153 may be constructed such that the air flow out of each of the horizontal and vertical jets is substantially the same as other horizontal and vertical jets. In other words, the plenum 153 may be configured such that jets on the side portions far away from the make-up air outlet 168 have the same or similar velocities and flow rates as the respective jets on the front portions of the jet generator 150 close to the 5 make-up air outlet 168. Alternatively, separate blanks can be provided for the side edges, which may be inserted into make-up air supply plenums on side edges (not shown) or portions of the make-up air supply plenum at the front edge.

The openings 142 and 160 allow air from the supply plenum 108 to escape into the recess of the exhaust hood, but the volume of supply air is substantially reduced from the rate of the original short-circuit system of FIG. 1. Openings 142 in jet generator 150 can generate jets 140 directed in a substantially horizontal direction (i.e., parallel to the ground) while openings 160 can generate jets 146 directed in a substantially vertical direction (i.e., perpendicular to the ground). Note that in the figures, only a portion of the jets have been shown for clarity of illustration. Openings 142 in jet generator 150 can be spaced apart a range of suitable distances and have diameters of various magnitudes to provide substantially a free planar jet whose throw is effectively about 30 to 90 percent of the dimension of the hood across the direction they face (front to back or side to side). The "throw" may be a distance of an isothermal jet when it reaches a terminal velocity of 5 feet per minute (fpm). The vertical holes 160 may be constructed to produce jets having a throw of about 20 to 90 percent of the vertical spacing between the appliance 120 and the lower edge 116 of the hood 101.

Another way to describe the configuration of the holes 142 and 160 is in terms of the equivalents of isothermal planar free jets that are formed by holes 142 (producing horizontally directed jets) and holes 160 (producing vertically directed jets). For example, holes 142 can each have a diameter of 5 mm and can be provided linearly in the jet generator 150 at a spacing of 32 mm on centers, and holes 160 can each have a diameter of 3.4 mm and can be provided linearly in the jet generator 150 at a spacing of 32 mm on centers. The holes can be simply punched into sheet metal of about 12 gauge, for example. The air supply to the holes 142 and 160 in the jet generator 150 can be at a pressure of 0.2 to 0.4 in water gauge, for example, 0.265 to 0.31 in water gauge. However, other configurations, including hole sizes, spacings, plenum pressures, elongated linear slots, hole shapes, etc., for generating curtain jets are also possible according to one or more contemplated embodiments.

In a typical short-circuit exhaust hood, the air flowing through the make-up grill 114 is about 50 cfm per linear foot of the hood (in a direction of the width of the exhaust hood), although wide variations in this number are possible. However, after insertion of the jet generator 150 according to embodiments of the disclosed subject matter, the resulting air flow emanating as horizontal and vertical jets is between 5 and 15 cfm per linear foot.

Figure 5:
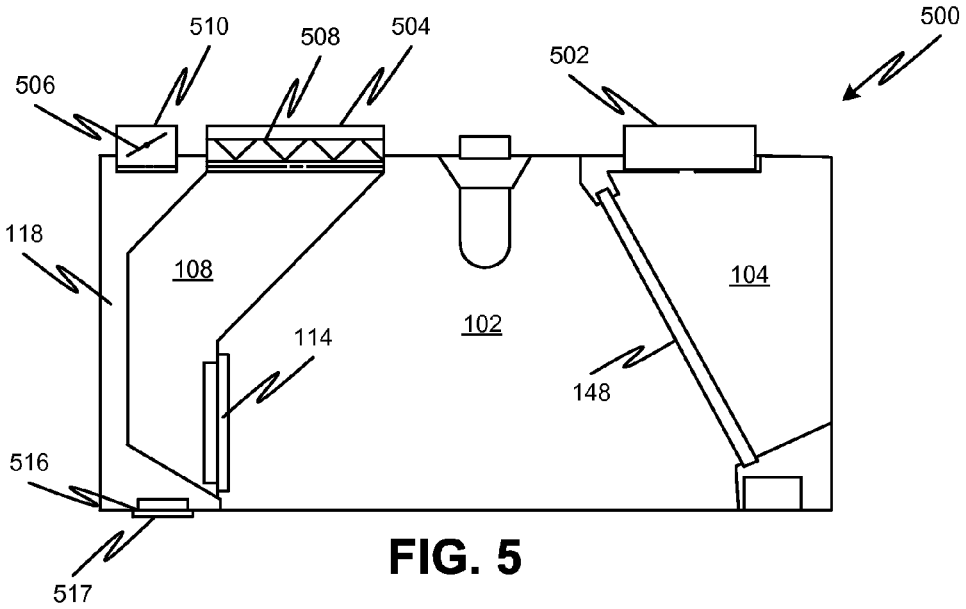
FIG. 5 shows a side cross-section of a short-circuit exhaust hood with conditioned air curtain.
Figure 6:
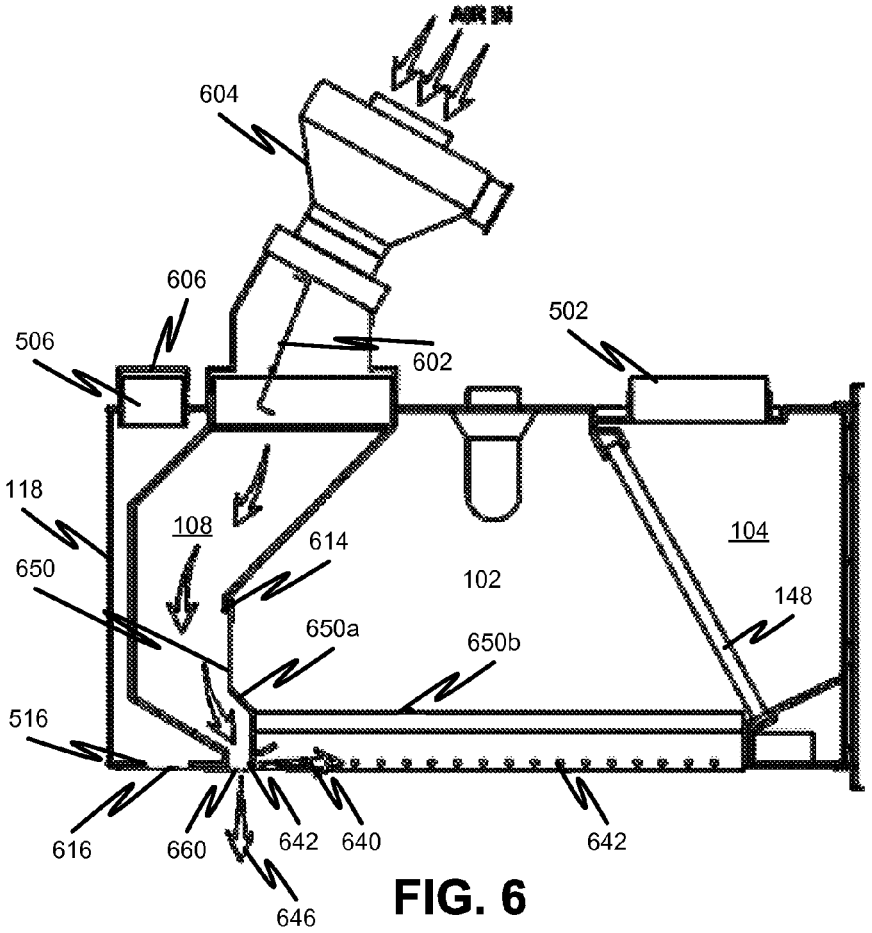
FIG. 6 shows a side cross-section of the short-circuit exhaust hood of FIG. 5 modified to generate horizontal and vertical jets, according to one or more embodiments of the disclosed subject matter.
Figure 7:
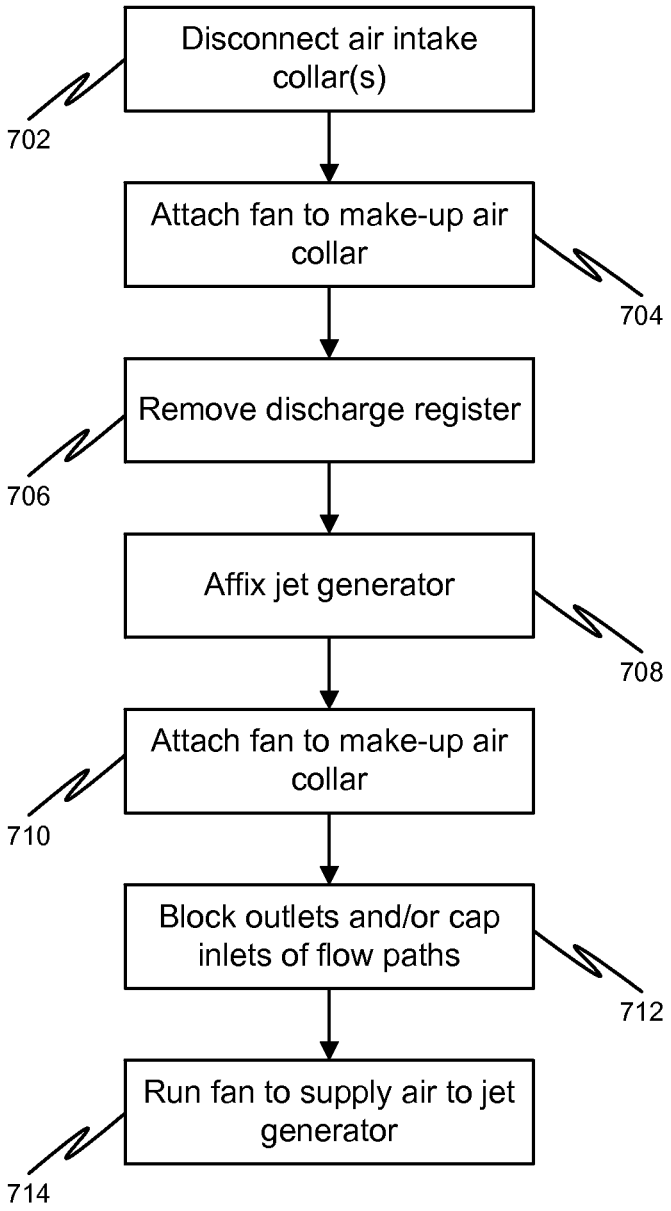
FIG. 7 is a simplified process flow diagram for a method of modifying a short-circuit exhaust hood to generate horizontal and vertical jets, according to one or more embodiments of the disclosed subject matter.

Additionally or alternatively, other changes to the short-circuit hood may be made to reconfigure the make-up air or conditioned air flow into the hood as horizontal and vertical jets. Referring to FIGS. 5-6, a short-circuit hood is shown in unmodified (FIG. 5) and modified (FIG. 6) configurations. FIG. 7 is a process flow diagram of a method for modifying the short-circuit hood shown in FIG. 5.

In the configuration of FIG. 5, the short-circuit hood 500 includes air volume control dampers 506, 508 that regulate respective flows of make-up air (i.e., through make-up air collar 504 to the supply plenum 108) and conditioned air (i.e., through HVAC unit collar 510 to the conditioned air duct 118). Conditioned air supplied to the conditioned air duct 118 is used to create a vertical curtain of fresh air at the front of the hood. Thus, air from the duct 118 is discharged at outlet 516 through a grill or diffuser 517. Meanwhile, make-up air (e.g., outside air) is provided via make-up air collar 504 to supply plenum 108 and then to the recess 102 of the hood through a grill or diffuser 114. Fumes and other gases in the recess 102 can be exhausted by a fan connected to exhaust duct collar 502, which withdraws the fumes from the recess 102 by way of filter 148 and exhaust plenum 104.

Referring now to FIG. 7, the retrofit of short-circuit exhaust hood 500 can begin at 702 with disconnecting the make-up air intake collar 504 from the make-up air supply (not shown). At 704, the make-up air volume control damper 508 can be removed. An optional fire damper 602 can be installed in the collar 504 or the upper portion of plenum 108 after removal of damper 508. Proceeding to 706, a fan 604 can be attached to the make-up air intake collar 504. The fan 604 can draw air from the ambient space (e.g., a hung ceiling space) as opposed to outdoor air or air directly from a duct of an HVAC system.

At 708, the discharge grill 114 in the supply plenum 108 can be removed, leaving behind a supply plenum outlet 614. At 710, a jet generator 650 can be installed at the supply plenum outlet 614 so at replace the discharge grill 114 with the plenum 615. As noted herein, the jet generator 650 can have a plurality of openings or holes 642, 660 therein. At 712, unused air flow paths of the short-circuit hood can be capped and/or blocked. For example, the air curtain duct 118 can be capped by cap 606 at the HVAC unit collar 506. Additionally or alternatively, the diffuser 517 can be removed, leaving behind an air curtain outlet 516, which can then be blocked by sealing portion 616, as shown in FIG. 6.

At 714, air can be provided to the supply plenum 108 by running fan 604, which in turn feeds holes 642 and 660 in jet generator 650 to form the horizontal jets 640 and vertical jets 646, respectively. Jet generator 650 can have a nose structure with a forward edge portion **650*a* and side edge portions 650*b* that wrap around the inside surfaces of the hood 500 so as to create vertical and horizontal facing openings 642, 600 along the lower edge of the hood 500. The fan can be controlled so as to regulate the pressure in the air supply plenum 108** to between 0.2 and 0.5 in water gauge and to provide a total volume flow rate of between 10 and 25 cubic feet per second (cps).

FIGS. 8A through 8H show views from the side and, in parts, in section.

Figure 8A:
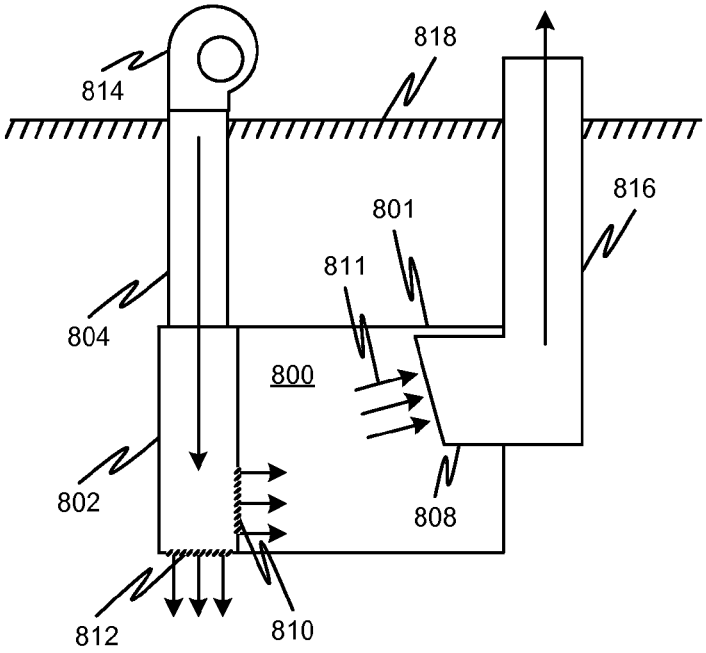
Prior art FIG. 8A
FIG. 8A is a generalized illustration of a short-circuit range hood according to the prior art.

FIG. 8A is a generalized illustration of a short-circuit range hood 801 according to the prior art. Outside air taken through a roof 818 penetration via a duct 804 is moved by a fan 814 to pressurize a short-circuit plenum 802 to provide make-up air to a short-circuit discharge register 810 and a ventilation register 812. Fumes, make-up air, and conditioned air are drawn into a recess 800 by an exhaust system 816 (only the duct is shown but the exhaust system may include one or more fans, flow control dampers, and other elements). The fumes, make-up air, and conditioned air are drawn from the recess 800 via a filter plenum 808 which may hold a grease filter (not shown) as illustrated by arrows 811. In variations of the basic design, one of the registers 810 and 812 may not be present. Where there is no register 810, vanes may direct the flow of register 812 toward the hood 801 inlet.

Figure 8B:
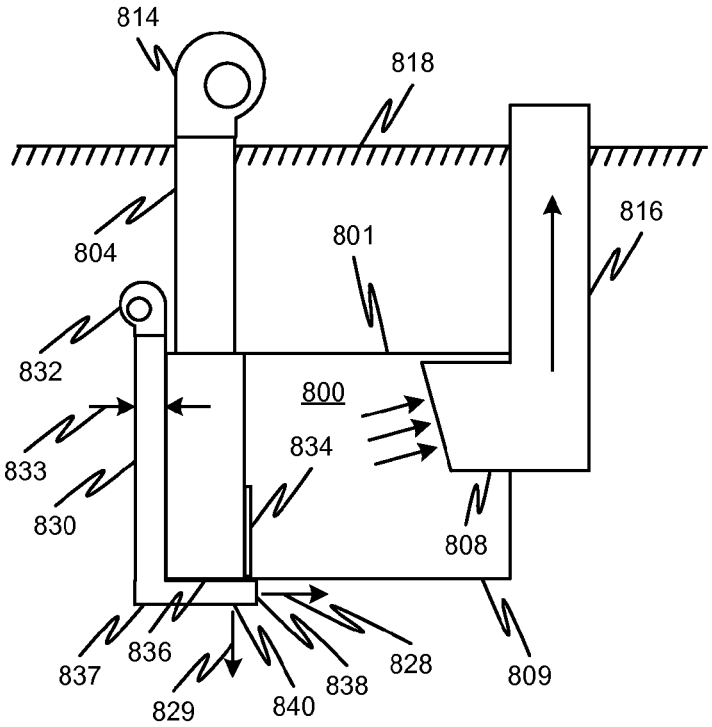
FIG. 8B shows a modification of the hood of FIG. 8A according to embodiments of the disclosed subject matter in which a conditioned air supply device operates to seal an unused make-up air register opening and positions jet generators to provide vertical and/or horizontal jets, according to respective embodiments.

FIG. 8B shows a modification of the hood of FIG. 8A according to embodiments of the disclosed subject matter in which a conditioned air supply device operates to seal an unused make up air register opening and positions jet generators to provide vertical and/or horizontal jets, according to respective embodiments. The fan 814 is disconnected and the short-circuit plenum 804 is sealed by blank 834, and a portion 836 of a jet generator plenum 830 is pressurized with conditioned air from the occupied space by a fan 832. Fumes, make-up air, and conditioned air are drawn into the recess 800 by the exhaust system 816.

Figure 8I:
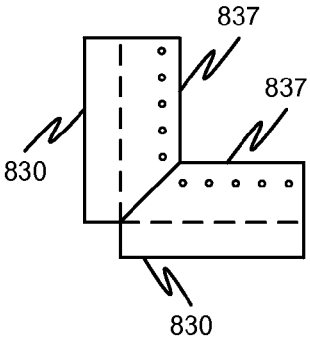
FIG. 8I shows a bottom view of adjacent jet generator plenums at a corner of the hood according to embodiments of FIGS. 8A through 8H.

The jet generator plenum may have a dimension (indicated at 833) relative to the front-back dimension of the hood that is thin, for example, 50 to 150 cm and may extend across the forward face of the hood. The jet generator creates linear jets in a generally horizontal direction 828 and a generally vertical direction 829 along the forward edge of the hood. The linear jets may be formed by flowing air through openings 838, 840, which may be an array of holes or a slit. The vertical and horizontal jets may also circumnavigate the hood lower edge on one or both lateral sides. In a canopy configuration, the vertical and horizontal jets may also circumnavigate the hood lower edge on all sides including the forward and back sides. In such configurations, separate plenums 830 may be used for each rectangular face of the hood 801 or the plenums may be combined. For example, a single plenum may wrap around two sides, three sides or all sides of the hood 801. At the corners, the lower part of the jet generator plenum 830 indicated at 837 may be beveled to allow positioning against an adjacent plenum on another face of the hood 801 as illustrated in FIG. 8I.

Figure 8C:
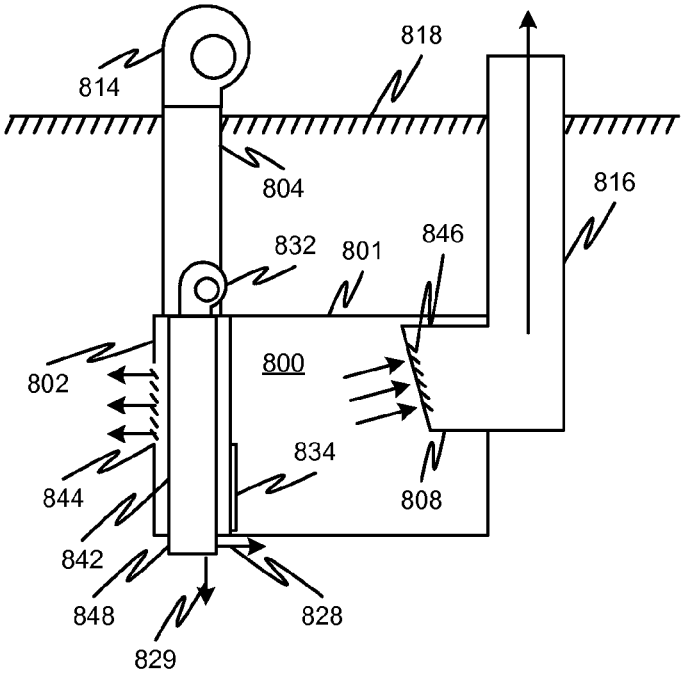
FIG. 8C shows a modification of the hood of FIG. 8A according to further embodiments of the disclosed subject matter in which a conditioned air supply device operates to seal an unused make-up air register opening and positions jet generators to provide vertical and/or horizontal jets, according to respective embodiments and in which the make-up air capacity of the short-circuit air supply is redirected and utilized.
Figure 8J:
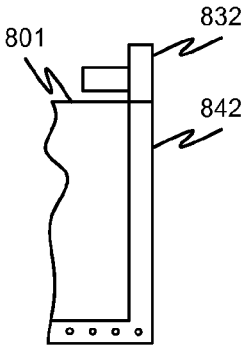
FIG. 8J is a view from the rear illustrating a jet generator plenum that wraps along a side of the hood and under it to distribute jets along a lower edge of the hood.

FIG. 8C shows a modification of the hood of FIG. 8A according to further embodiments of the disclosed subject matter in which a conditioned air supply device operates to seal an unused make-up air register opening and to provide vertical and/or horizontal jets, according to respective embodiments and in which the make-up air capacity of the short-circuit air supply is redirected and utilized. A jet generator plenum 848 is pressurized with conditioned air from the occupied space by a fan 832. The fan 814 remains to function for the supply of make-up air, however, the short-circuit plenum is modified by forming a discharge register 844 which vents make-up air directly to a conditioned space outside the hood 801. The short-circuit plenum 802 is sealed by blank 834 and a portion 848 of a jet generator plenum 842. Fumes, make-up air, and conditioned air are drawn into the recess 800 by the exhaust system 816. As above, in variations of the basic design, one of the registers 810 and 812 may not be present and where there is no register 810, vanes may direct the flow of register 812 toward the hood 801 inlet. The jet generator plenum 842 wraps around the short-circuit plenum 802 not from the front toward the rear as in the embodiment of FIG. 8B, but down along the side of the short-circuit plenum and then along the bottom as shown in FIG. 8J.

A further feature that may or may not be present in any of the embodiments of FIGS. 8A through 8H is an additional or replacement grease filter 846 that reduces the rate of exhaust by generating greater pressure drop than an original filter (not shown). By using a filter with a higher pressure drop, the grease capture effectiveness may be enhanced. For example, the filter may have a greater number of turns, sharper turns, or more tortuous turns therein as would be understood by those skilled in the design of grease filters. These higher efficiency grease filters may be readily designed and may be identified as inertial type grease filters. So the substitution is of a first inertial grease filter with a second one characterized by a higher pressure drop for a given volume flow rate and concomitantly higher capture effectiveness. As is known in the art, the higher capture effect is produced as a result of capturing smaller particles by the second as compared to the first. The replacement of the original filters may be a feature of any of the embodiments disclosed. The reduction of flow may correspond to the reduced amount of exhaust required for capture and containment as a result of the provision of the vertical and horizontal jets and the elimination of the short-circuit arrangement, which is less effective for a given net exhaust rate than a hood without.

As above, the jet generator creates linear jets in a generally horizontal direction 828 and a generally vertical direction 829 along the forward edge of the hood. The linear jets may be formed by an array of holes or a slit. The vertical and horizontal jets may also circumnavigate the hood lower edge on one or both lateral sides with suitable arrangement of the plenum 848. In a canopy configuration, the vertical and horizontal jets may also circumnavigate the hood lower edge on all sides including the forward and back sides.

Figure 8D:
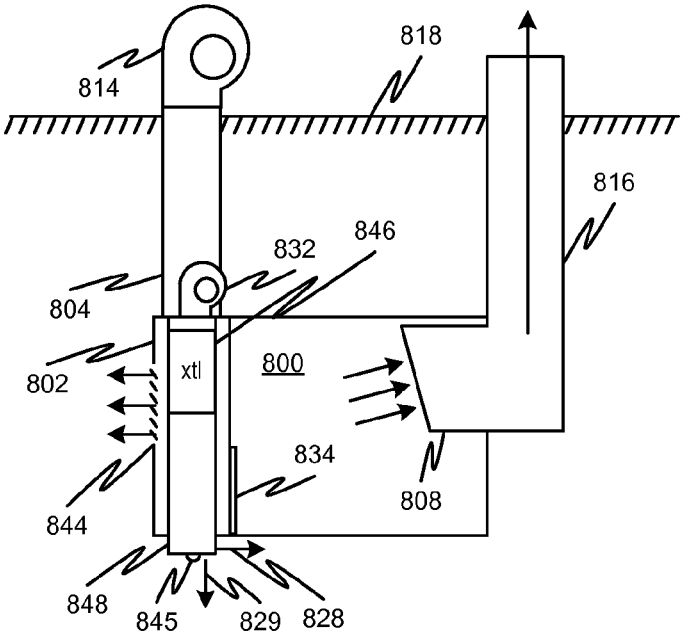
FIG. 8D shows a modification of the hood of FIG. 8A according to further embodiments of the disclosed subject matter in which a conditioned air supply device operates to seal an unused make-up air register opening and positions jet generators to provide vertical and/or horizontal jets, according to respective embodiments and in which an excess capacity of the hood is throttled using a higher pressure drop or adjustable grease filter.

FIG. 8D shows a modification of the hood of FIG. 8A according to further embodiments of the disclosed subject matter in which a conditioned air supply device operates to seal an unused make-up air register opening and provides vertical and/or horizontal jets, according to respective embodiments and in which an excess capacity of the hood is throttled using a higher pressure drop or adjustable grease filter. A jet generator plenum 848 is pressurized with conditioned air from the occupied space by the fan 832. The fan 814 remains to function for the supply of make-up air with the short-circuit plenum modified as above to vent make-up air directly to a conditioned space outside the hood 801. The short-circuit plenum 802 is sealed as above by blank 834 and a portion 848 of the jet generator plenum 842. Fumes, make-up air, and conditioned air are drawn into the recess 800 by the exhaust system 816. As above, in variations of the basic design, one of the registers 810 and 812 may not be present and where there is no register 810, vanes may direct the flow of register 812 toward the hood 801 inlet 805. The jet generator plenum 842 wraps around the short-circuit plenum 802 not from the front toward the rear as in the embodiment of FIG. 8B, but down along the side of the short-circuit plenum and then along the bottom as shown in FIG. 8J.

A further feature that may or may not be present in any of the embodiments of FIGS. 8A through 8H is a controller 846 configured to modulate the make-up air and, optionally also, the exhaust flow rates in order to match the make-up air supply in demand-based exhaust control. The controller may be integrated mechanically as part of the jet generator plenum 848, fan 832, and provided as a unitary device. Sensors such as infrared imaging sensors may be combined with such a unitary device and used to modulate the exhaust rate and make-up air rates according to a demand control scheme. Thus, controller 846 may be connected as a controller of the exhaust rate, which may be the exhaust fan speed or a damper (not shown), as well as connected to the fans 832 and 814 to modulate rates of exhaust and make-up air, according to demand control as indicated by the sensor and other inputs. For example, a scheme and component details may be provided according to International Publication No. WO 2010/065793, entitled "Exhaust Flow Control System and Method," which is hereby incorporated by reference herein in its entirety.

As above, the jet generator creates linear jets in a generally horizontal direction 828 and a generally vertical direction 829 along the forward edge of the hood. The linear jets may be formed by an array of holes or a slit. The vertical and horizontal jets may also circumnavigate the hood lower edge on one or both lateral sides with suitable arrangement of the plenum 848. In a canopy configuration, the vertical and horizontal jets may also circumnavigate the hood lower edge on all sides including the forward and back sides.

Figure 8E:
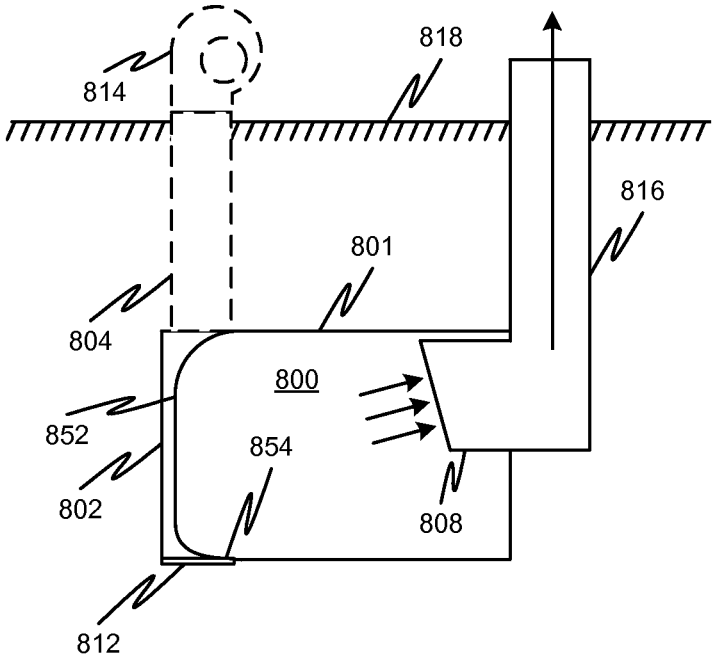
FIG. 8E shows a modification of the hood of FIG. 8A according to further embodiments of the disclosed subject matter in which an interior volume of the hood is increased by modifying a forward inside wall of the hood which displaces unused volume of the make-up air plenum of the short-circuit air supply.

FIG. 8E shows a modification of the hood of FIG. 8A according to further embodiments of the disclosed subject matter in which an interior volume of the hood is increased by modifying a forward inside wall of the hood which displaces unused volume of the make-up air plenum of the short-circuit air supply. In the modification, the short-circuit fan 814 and 804 may be blocked off (for example by blanks such as blank 812) or removed altogether. The forward wall of the interior of the hood 801 and the short circuit plenum 802 is removed or cut to enlarge the hood 801 recess 800. In an embodiment, a curved wall as indicated at 852 may be secured in position to provide a smooth transitional configuration that causes buoyancy-driven fumes that are not immediately drawn into the filter plenum 808 to follow the wall 852 and deflected by a lip 854 back toward the hood recess 800.

Figure 8F:
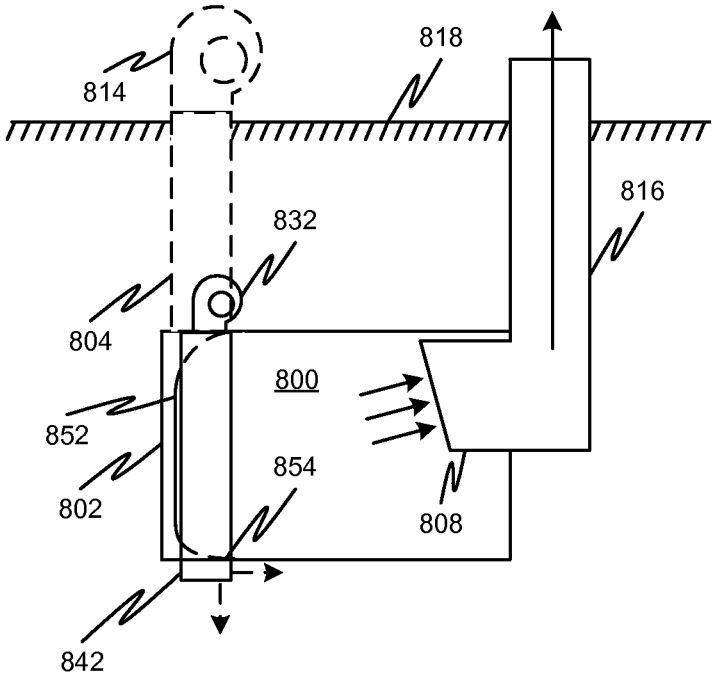
FIG. 8F shows a modification of the hood of FIG. 8A according to further embodiments of the disclosed subject matter in which an interior volume of the hood is increased by modifying a forward inside wall of the hood which displaces unused volume of the make-up air plenum of the short-circuit air supply and in which jet generators to provide vertical and/or horizontal jets.

FIG. 8F shows a modification of the hood of FIG. 8A according to further embodiments of the disclosed subject matter in which an interior volume of the hood is increased by modifying a forward inside wall of the hood which displaces unused volume of the make-up air plenum of the short-circuit air supply and provides vertical and/or horizontal jets via a jet generator. FIG. 8F illustrates the similar features as FIG. 8E, however a jet generator 842 and fan 832 may be arranged as described with reference to FIG. 8C.

Figure 8G:
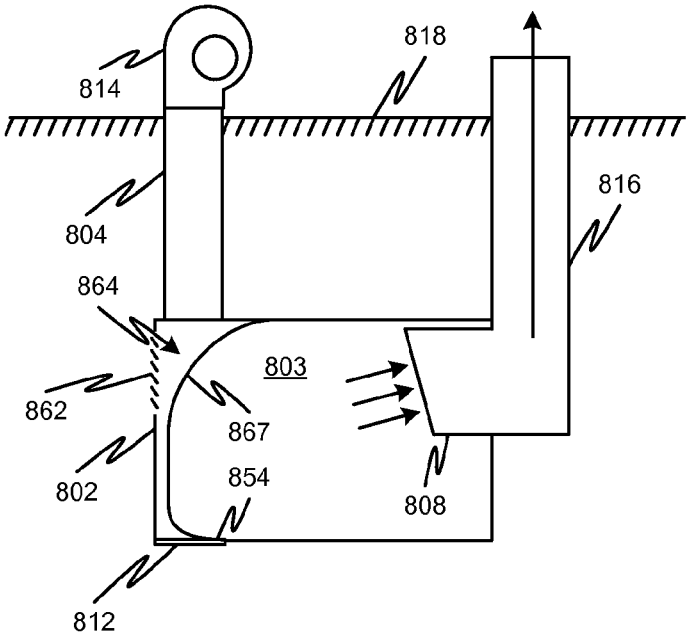
FIG. 8G shows a modification of the hood of FIG. 8A according to further embodiments of the disclosed subject matter in which an interior volume of the hood is increased by modifying a forward inside wall of the hood which displaces unused volume of the make-up air plenum whilst redirecting the make-up air through a separate register of the short-circuit air supply.

FIG. 8G shows a modification of the hood of FIG. 8A according to further embodiments of the disclosed subject matter in which an interior volume of the hood is increased by modifying a forward inside wall of the hood which displaces unused volume of the make-up air plenum whilst redirecting the make-up air through a separate register of the short-circuit air supply. In this variant, the short-circuit fan 814 and supply 804 are retained and used to feed a revised make-up air plenum 864 that utilizes part of the original short-circuit plenum volume, part of which is shared by a new interior volume 803 of the hood 801. The curved wall 867 is emplaced in the manner described with respect to FIG. 8E but the shape permits a sufficient volume to be provided for the make-up air plenum 864. A discharge register 862 discharges make-up air into a conditioned space.

Figure 8H:
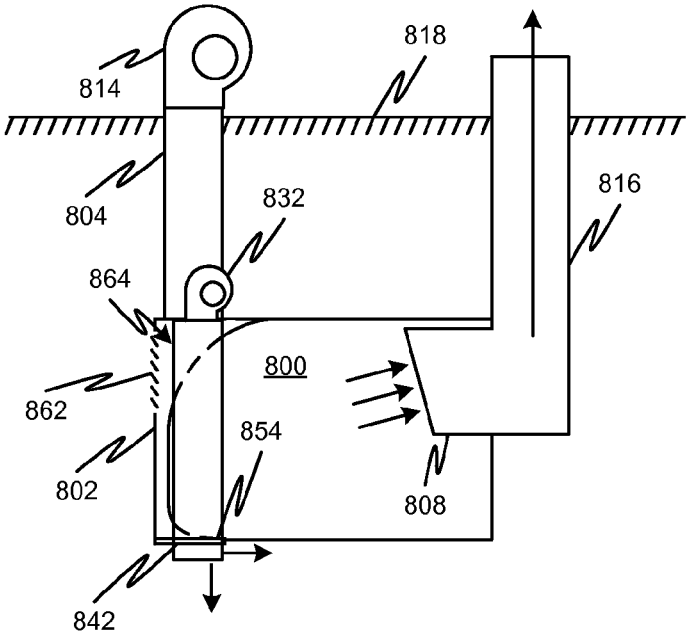
FIG. 8H shows a modification of the hood of FIG. 8A according to further embodiments of the disclosed subject matter in which an interior volume of the hood is increased by modifying a forward inside wall of the hood which displaces unused volume of the make-up air plenum whilst redirecting the make-up air through a separate register of the short-circuit air supply and in which jet generators to provide vertical and/or horizontal jets.

FIG. 8H shows a modification of the hood of FIG. 8A according to further embodiments of the disclosed subject matter in which an interior volume of the hood is increased by modifying a forward inside wall of the hood which displaces unused volume of the make-up air plenum whilst redirecting the make-up air through a separate register of the short-circuit air supply and in which vertical and/or horizontal jets are provided by a jet generator. FIG. 8H illustrates similar features as FIG. 8E, however a jet generator 832 and fan 842 may be arranged as described with reference to FIG. 8C.

For any of the embodiments of FIGS. 8B through 8H, an embodiment of the disclosed subject matter can include kits which may be assembled to provide the describe supplemental components for modification of the prior art hood.

It will be evident to those skilled in the art that the embodiments of the disclosed subject matter are not limited to the details disclosed herein, and that the present invention may be embodied in other specific forms without departing from the spirit or essential attributes thereof. For example, while jets have been described as formed using a series of round nozzles, it is clear that it is possible to form jets using a single slot or non-round nozzles. Also, the source of air for the jets may be room air, outdoor air or a combination thereof. In addition, embodiments of the disclosed subject matter are applicable to any process that forms a thermal plume, not just a kitchen range. The principles disclosed and described herein can be applied to many different types and styles of exhaust hoods, including, but not limited to back shelf and canopy style hoods.

Features of the disclosed embodiments may be combined, rearranged, omitted, etc., within the scope of the invention to produce additional embodiments. Furthermore, certain features may sometimes be used to advantage without a corresponding use of other features.

It is thus apparent that there is provided, in accordance with the present disclosure, exhaust hood methods, devices, and systems. Many alternatives, modifications, and variations are enabled by the present disclosure. While specific embodiments have been shown and described in detail to illustrate the application of the principles of the present invention, it will be understood that the invention may be embodied otherwise without departing from such principles. Accordingly, Applicants intend to embrace all such alternatives, modifications, equivalents, and variations that are within the spirit and scope of the present invention.

The invention claimed is:

1. A method for modifying a short-circuit exhaust hood, comprising:

exchanging a jet generator for a make-up air discharge register, which covers an outlet of an air supply plenum and through which air from the air supply plenum enters into a recess of the short-circuit exhaust hood, wherein the exchanging includes removing the discharge register and sealing an upper portion and a lower portion of the jet generator around the air supply plenum outlet, the jet generator together with surfaces of the short-circuit exhaust hood forms a plenum that conveys the air from the air supply plenum outlet to a plurality of first and second openings in the jet generator, the first openings are constructed to form horizontally directed jets having a velocity of at least 4 m/s at a lower end of the recess, the second openings are constructed to form vertically directed jets having a velocity of at least 4 m/s at the lower end of the recess, and the jet generator has a protruded shape in cross-section such that both the first and second openings are spaced from the upper portion of the jet generator and the air supply plenum outlet in a horizontal direction.

2. The method of claim 1, wherein the jet generator has a nose shape in cross-section, or is beveled or curved in cross-section at an intermediate portion between said upper and lower portions.

3. The method of claim 1, wherein the jet generator includes a pair of arms extending horizontally along sides of the exhaust hood, each arm including additional ones of the first and second openings therein for generating additional horizontal and vertical jets.

4. The method of claim 3, wherein a jet generator plenum is connected to said pair of arms so as to provide air from the air supply plenum to said additional ones of the first and second openings by way of the jet generator plenum.

5. The method of claim 1, further comprising flowing air through the air supply plenum to the jet generator so as to produce said horizontal and vertical jets.

6. The method of claim 1, wherein the jet generator protrudes into and occupies space at the lower end of the recess that was previously open space.

7. A jet generating apparatus for use in a short-circuit exhaust hood with a forward edge, the short-circuit exhaust hood having a make-up air supply plenum with an outlet in fluid communication with a recess of the short-circuit exhaust hood, the jet generating apparatus comprising:

a first portion extending in a substantially vertical direction;

a second portion extending in a substantially horizontal direction;

an outlet portion at a horizontal end of the second portion, the outlet portion including a plurality of first and second openings therein;

an intermediate portion connecting the first portion to the outlet portion, wherein the first openings are constructed to form first jets in the horizontal direction and the second openings are constructed to form second jets in the vertical direction, the first jets and the second jets being co-located along the outlet portion, the first and second portions are constructed to seal said air supply plenum outlet when installed in the short-circuit exhaust hood, the outlet portion has a protruded shape in cross-section such that both the first and second openings are spaced farther from said forward edge of the short-circuit exhaust hood in said horizontal direction than the outlet of the make-up air supply plenum, and the jet generator is retrofitted into the short-circuit exhaust hood with outer faces of the jet generator contacting inward facing sides of the recess of the short-circuit exhaust hood.

8. The apparatus of claim 7, wherein the jet generating apparatus has a nose shape in cross-section, or said intermediate portion comprises a bevel or curve in cross-section.

9. The apparatus of claim 7, further comprising a pair of arms extending in the horizontal direction from lateral ends of the jet generating apparatus, each arm including a respective outlet portion with additional ones of the first and second openings therein for generating additional horizontal and vertical jets.

10. The apparatus of claim 7, wherein the first, second, outlet, and intermediate portions are formed from a single sheet metal blank, and the first and second openings are punched holes in the sheet metal blank.

11. The apparatus of claim 7, wherein the openings have a maximum dimension of no more than 5 mm.

12. The apparatus of claim 7, wherein a diameter of the first openings are larger than a diameter of the second openings.

13. The apparatus of claim 7, wherein a spacing between adjacent ones of the first openings is the same as a spacing between adjacent ones of the second openings.

14. A method for modifying a short-circuit hood, the method comprising:

replacing a make-up air system or conditioned air supply system, which provides a flow of air at a front of the short-circuit hood via a respective outlet, with a jet generator that forms a combination of horizontally and vertically directed jets along a lower portion of a recess of the short-circuit hood at said front, the horizontally and vertically directed jets having a velocity of at least 4 m/s.

15. The method of claim 14, wherein said replacing includes:

installing the jet generator at the front of the short-circuit hood;

closing flow paths of the system that provided flow of air at the front of the short circuit hood; and adding a new flow path for supplying air to the jet generator.

16. The method of claim 14, wherein said replacing includes:

installing the jet generator at the outlet of the make-up air system so as to convert the make-up air flow into said horizontally and vertically directed jets; and closing flow paths of the conditioned air supply system when the conditioned air supply system is being replaced.

17. The method of claim 14, wherein said replacing includes:

installing the jet generator at the outlet of the conditioned air supply system so as to convert the conditioned air flow into said horizontally and vertically directed jets; and closing flow paths of the make-up air system when the make-up air system is being replaced.

18. The method of claim 14, wherein said replacing includes:

installing the jet generator at the outlet of the make-up air system;

severing a connection between a make-up air supply of the make-up air system and the outlet of the make-up air system; and connecting a fan to the severed connection so as to provide air to the installed jet generator to form the horizontally and vertically directed jets.

19. The method of claim 18, wherein said fan draws air from a region of conditioned space.

20. The method of claim 19, wherein said region is a hung ceiling space over a kitchen where the short-circuit hood is installed.

* * * * *